United States Patent [19]

Stanton

[11] Patent Number: 4,952,255

[45] Date of Patent: Aug. 28, 1990

[54] EXTRUDABLE PBX MOLDING POWDER

[75] Inventor: Horace D. Stanton, Ridgecrest, Calif.

[73] Assignee: The United States of America as represented by the Secretary of the Navy, Washington, D.C.

[21] Appl. No.: 596,188

[22] Filed: Apr. 2, 1984

[51] Int. Cl.[5] ..... C06B 45/10

[52] U.S. Cl. ..... 149/19.91; 149/19.92; 149/92; 149/109.6; 264/3.3; 264/3.4

[58] Field of Search ..... 149/19.91, 19.92, 92, 149/109.6; 264/3 B

[56] References Cited

U.S. PATENT DOCUMENTS

| | | | |
|---|---|---|---|
| 3,020,181 | 2/1962 | Proell et al. | 149/19 |
| 3,113,894 | 12/1963 | Burton | 149/19 |
| 3,296,041 | 1/1967 | Wright | 149/2 |
| 3,428,502 | 2/1968 | Evans | 149/19 |
| 3,544,360 | 12/1970 | Gardner | 117/100 |
| 3,834,957 | 9/1974 | McDevitt et al. | 149/19.4 |
| 4,090,894 | 5/1978 | Reed et al. | 149/19.91 |
| 4,137,849 | 2/1979 | Hontgas et al. | 102/481 |

*Primary Examiner*—Stephen J. Lechert, Jr.
*Attorney, Agent, or Firm*—Sol Sheinbein; Melvin J. Sliwka

[57] ABSTRACT

An extrudable plastic bonded explosive molding powder is provided and contains about 20 percent by weight ethylenevinyl acetate copolymer and 80 percent by weight PETN.

2 Claims, No Drawings

EXTRUDABLE PBX MOLDING POWDER

BACKGROUND OF THE INVENTION

1. Field of the Invention

The present invention relates to explosives. More particularly, this invention relates to an injectionable/extrudable free flowing molding powder for plastic bonded explosives.

2. Description of the Prior Art

The explosive, PBXN-301, has been utilized in initiating devices. It is formulated from 20 percent Sylgard resin system (resin plus curative) and 80 percent pentaerythritoltetranitrate (PETN). The chemical name for PETN is 2,2-bis[(nitroxy)methyl]-1,3-propanedioldinitrate. The Sylgard resin and PETN are mechanically mixed together and then milled or homogenized by use of a roller mill. Up to 25 runs through the mill can be required to achieve the final consistency of a smooth putty material. The material could then be processed by injection into initiating devices.

The PBXN-301 formulation requires the use of special recrystallized PETN. Further, the mixture has a sensitive platinum curing agent which can be contaminated during the milling stage and result in the ruin of the entire batch. The requirement of the large number of milling runs can amplify this problem. After the final milling, the material must be stored at temperatures between −30° C.−−60° C. Once removed from cold storage, any unused excess material must be scrapped. Even with cold storage, the shelf life of the material is only six months to a year.

OBJECTS OF THE INVENTION

It is an object of this invention to provide an explosive material with improved properties as a replacement or alternative for the previous PBXN-301 formulation.

Another object of the invention is to provide an explosive material having an indefinite shelf life at ambient storage temperatures.

Still another object of the invention is to provide a free flowing explosive molding powder that can be processed by either injection or extrusion.

These and other objects, advantages and novel features of the present invention will become apparent from the following detailed description of the invention.

SUMMARY OF THE INVENTION

Accordingly, the present invention provides an explosive composition comprising 20 percent by weight ethylene-vinyl acetate copolymer and 80 percent by weight pentaerythritoltetranitrate. This composition yields a free flowing injectionable/extrudable molding powder having an indefinite shelf life, room temperature storage capabilities and one step mixing requirements. Therefore, the resultant molding powder is much more cost effective than previous PETN based compositions.

DESCRIPTION OF THE PREFERRED EMBODIMENT

In contrast to the requirement for special recrystallized PETN, the present invention can utilize commercially available PETN. One example would be superfine PETN supplied by Du Pont. This ability to avoid the recrystallization simplifies the formulation.

The extrudable plastic bonded explosive molding powder is formulated using 80 percent by weight of the commercially available PETN and 20 percent by weight of the ethylene-vinyl acetate (EVA) copolymer. The copolymer consists of 40 percent by weight vinyl acetate and 60 percent by weight ethylene and has a melt flow rate of 9.0 gm/10 min. The EVA copolymer is dissolved in a solvent and mixed together with the PETN. The solvent is allowed to evaporate while the mixture is mechanically mixed. A Baker-Perkins type mixer is suitable. Any solvent, such as hexane, capable of dissolving the EVA can be used. After evaporation the semi-dry material is dried in an oven for 6 to 10 hours at 65° to 70° C.

The extruded form of this material has many useful military applications. It has been extruded into tough flexible strands of over twelve feet in length with diameters ranging from 0.030 inches to 3.250 inches. The material has also been injected into devices having long narrow channels. Projected uses for the extruded strands are: leads in fuzes, transfer links, proto type multapoint initiation systems, superquick delay elements, logic systems, surface initiation systems and other applications where PBXN-301 is presently being used.

Table 1 illustrates the basic insensitivity of the molding powder.

TABLE 1

| Explosive sample | Impact sensitivity | Friction sensitivity | Electrostatic sensitivity |
|---|---|---|---|
| PETN(neat) | 10 cm | 145 lbs. (50% point) | 7/10 NF At 0.25 joules |
| 20 gm handmix of 80% PETN/20% EVA | 26 cm | 10/10 NF 1000 lbs. | 10/10 NF at 0.25 joules |
| 150 gm Baker Perkins mix of 80% PETN/ 20% EVA | 28 cm | 10/10 NF at 1000 lbs. | 10/10 NF at 0.25 joules |

Obviously many modifications and variations of the present invention are possible in light of the above teachings. It is to be understood that within the scope of the appended claims, the invention may be practiced other than as specifically described.

What is claimed is:

1. An extrudable explosive molding powder comprising:

about 20 percent by weight of an ethylene-vinyl acetate copolymer; and about 80 percent by weight pentaerythritoltetranitrate.

2. A method of producing an extrudable explosive molding powder comprising the steps of:

dissolving ethylene-vinyl acetate copolymer in a solvent;

mixing pentaerythritoltetranitrate into said dissolved ethylene-vinyl acetate copolymer;

evaporating said solvent from said mixture; and drying said mixture at 60°–70° C.

* * * * *